US007159734B1

(12) United States Patent
O'Brien

(10) Patent No.: US 7,159,734 B1
(45) Date of Patent: Jan. 9, 2007

(54) PAINT CONTAINER LINER SYSTEM

(75) Inventor: Robert O'Brien, Berkeley, CA (US)

(73) Assignee: Dripless, Inc., Santa Rosa, CA (US)

( * ) Notice: Subject to any disclaimer, the term of this patent is extended or adjusted under 35 U.S.C. 154(b) by 194 days.

(21) Appl. No.: 10/754,287

(22) Filed: Jan. 8, 2004

Related U.S. Application Data

(60) Division of application No. 09/407,005, filed on Sep. 28, 1999, now Pat. No. 6,679,398, which is a continuation-in-part of application No. 09/052,496, filed on Mar. 30, 1998, now abandoned, which is a continuation-in-part of application No. 08/660,525, filed on Jun. 7, 1996, now abandoned.

(51) Int. Cl.
*B65D 25/14* (2006.01)

(52) U.S. Cl. ..... 220/495.07

(58) Field of Classification Search ..... None
See application file for complete search history.

(56) References Cited

U.S. PATENT DOCUMENTS 2,324,440 A * 7/1943 Tormohlen ..... 220/495.07
3,734,340 A * 5/1973 Ippolito et al. ..... 141/391
4,950,236 A * 8/1990 Wilson ..... 604/74
5,078,297 A * 1/1992 Howard et al. ..... 220/533
5,205,409 A * 4/1993 Bruno ..... 206/370
5,305,909 A * 4/1994 Merritt ..... 220/579

* cited by examiner

*Primary Examiner*—Stephen Castellano
(74) *Attorney, Agent, or Firm*—Richard Esty Peterson

(57) ABSTRACT

A paint container liner system including disposable liners and an open container for receiving at least one of the disposable liners, the liners being sized and configured to fit into the inside of the container and around the rim of the container, the liners being maintained in position in the container by a suction generated during installation in one embodiment and by a noncuring adhesive interposed between the liner and container in another embodiment, the liners also being stretched around the rim of the container and in another embodiment configured with a rounded bottom to retain the liner in place during use, the system also including a container cap with a slot for supporting a paint brush during periods of nonuse.

10 Claims, 4 Drawing Sheets

PAINT CONTAINER LINER SYSTEM

This is a divisional application of Ser. No. 09/407,005, filed Sep. 28, 1999, now U.S. Pat. No. 6,679,398, which was a continuation-in-part application of Ser. No. 09/052,496 filed on Mar. 30, 1998, now abandoned, which was also a continuation-in-part of Ser. No. 08/660,525 filed on Jun. 7, 1996, now abandoned.

BACKGROUND OF THE INVENTION

This invention relates to a paint container and liner system and in particular to disposable liners that are flexible so that the liner can conform to the shape of the standard paint bucket and remain in place during use without being precisely contoured to the inside dimensions of the bucket.

Various improvements in materials and equipment for painting have been developed to facilitate what is unavoidably a messy task. Only a very few of these improvements have related to the environmental consequences such as the reduction in the amount of solvents that escape into the air when paint dries. As more is learned about the toxicity of even modern water-based paints, improvements in disposal of waste water and solvents from clean-up procedures need to be implemented to help meet even stricter environmental regulations. The proposed liner system of this invention would eliminate the use of water or solvents for clean-up of paint buckets. It will also reduce the landfill overuse problem by reducing the number of plastic buckets thrown away because of the difficulty in cleaning them.

The need for an easily used and readily disposable liner is apparent. However, while the need for a liner may be apparent, the use of a simple liner, (one that is economical such as the poly-bags which are produced in bulk and are flat for compact for shipment and storage) poses difficulties because the liner may lose its preferred position in a paint container. A paint brush is not simply dipped into the paint in a container, but is pressed and displaced against the wall of the container to distribute the desired quantity of paint on the brush, potentially displacing a liner. Maintaining a liner in a condition that conforms to the shape of the bucket adds to the ultimate value of a liner because it increases its utility. The combined liner and bucket functions in a manner that is similar to the unlined bucket during use, but has the advantage of facilitating cleanup and disposal of paint residue leaving the bucket immediately ready for reuse.

In one embodiment of the invention a group nested liners are installed in the paint bucket and incrementally used and disposed. These features contribute to a liner system that is both convenient to use and ecologically friendly.

SUMMARY OF THE INVENTION

The paint container and liner system of this invention is devised to line a container with a disposable, paint impervious liner to enable disposal of a liner together with any residue paint waste and to allow reuse of the container by relining the container with a clean liner. The liner may be used with a variety of containers such as a paint bucket. Successful use of the disposable liner system is in part dependent on the convenience of the system and the stability of the liner when installed in a container. Alternate methods of stabilizing one or more liners in a container are described.

Furthermore, to maintain the positioning of the liner around the perimeter of the container opening, the liner is attached to the outer portion of the container rim by one of a several means. This is best accomplished in the case of a cylindrical paint bucket by designing a liner that has the configuration of a substantially rectangular bag with an opening that is stretched to tightly fit around the rim of the paint bucket. Since the mouth of the bag is stretched slightly to be installed over the rim of the bucket, it is preferred that the bag has a resiliency to enable both a satisfactory engagement of the bag to the outside of the bucket rim, and to provide a sufficient circumference to the remaining part of the bag to maintain itself against the inside wall of the container. A simple plastic bag that is rectangular in construction with a sufficient dimension to conform to the perimeter of the container bottom is adequate.

However, in the embodiments where multiple liners are nested and installed as a group in a paint bucket, rectangular shaped bags, are installed in a radially staggered manner or have rounded bottom corners to prevent the bags from interlocking at the corners.

It has been found that with the proper use of a special installation implement such a plastic liner or group of liners can be press fit into a paint bucket with virtually all air eliminated from between the liner and the bucket. Because of the absence of air, the bag or bags stay stationed against the inside of the bucket and retain their position during use.

Preferably, the installation implement is a bucket-like plug having an outside dimension that is substantially the same as the inside dimension of the paint bucket. The bucket-like plug or plug bucket preferably has a deformable, e.g. foam, outside surface to accommodate folds and overlaps in the bag. Because the primary function of the plug bucket is the placing of the flexible liner into the paint bucket, the plug bucket's exterior surface must be defined only by the shape of the interior of the bucket to be lined. Therefore, the plug bucket has no bail or reinforcing rim structure extending outside the rim like standard buckets. Instead, the reinforcing structure of the plug bucket is located inside the rim. In a preferred embodiment the lid of the plug bucket engages the interior reinforcing rim of the plug bucket so as not to create an obstruction on the outside of the plug bucket. The lid also has a dispensing hole for convenient storage and removal of flexible liners that can be sold separately from the plug bucket.

During installation, the flexible liner is first drawn over the exterior of the plug bucket. Second, the plug bucket contained within the flexible liner is pushed into the paint bucket firmly to evacuate the air from between the liner and the wall of the paint bucket. Third, the opened end of the flexible liner is stretched over the rim of the paint bucket to create the seal for preventing air entry between the liners and the inside bucket wall. Fourth, the plug bucket is removed, and the lined paint bucket is ready for use.

This suction process of adhering a liner to the container may be accomplished by the manufacturer with a plurality of liners nested within the container. When a plurality of liners are pre-installed, the liners are first installed over a mandrel. To prevent the corners of rectangular liners from interlocking the position of the liners are radially displaced from one another on the mandrel. The mandrel with the mounted liners is inserted into the paint bucket and the open top edge of the liners are stretched over the top rim of the bucket, preferably one at a time beginning with the outermost liner. In such embodiment a plurality of liners installed in a paint bucket can be maintained in position before use by a simple cardboard plug. The plug keeps the nested liners from puffing during the time before sale and use. Prior to use the cardboard plug is removed and discarded.

The system of liners is preferably combined with a stretchable bucket cap to keep paint temporarily contained in the bucket from drying. The liners and bucket cap can be provided as a kit together with a paint bucket. Additionally, replacement liners are provided for maintaining the usefulness of the kit and prolonging the life of the bucket before being discarded.

Successive use of the pre-installed liners would continue until the installed supply of liners was exhausted. The user may then adopt the manual installation system described. Alternately, the user may buy another bucket with multiple liners already installed.

DETAILED DESCRIPTION OF THE PREFERRED EMBODIMENTS

Figure 1:
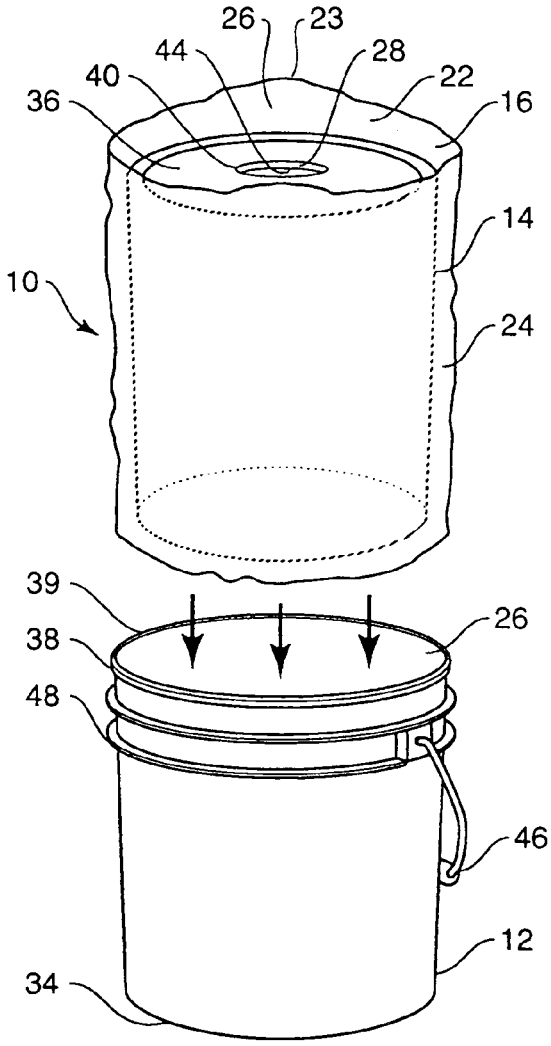
FIG. 1 is an exploded perspective view of the paint bucket liner system including a conventional reusable paint bucket and disposable liner.

Referring to the exploded view of FIG. 1, three primary components of one embodiment of the liner system 10 are shown. The liner system 10 of FIG. 1 is preferably marketed as a kit. One kit includes a standard plastic paint bucket 12, a press-fit, plug bucket 14, and a supply of liners 16. One of the liners 16 is shown encasing the plug bucket 14 in FIG. 1. The liners 16 are fabricated of flexible plastic material approximately 0.7 mil in thickness and, as shown in FIG. 3, are substantially rectangular in shape with a sealed bottom 18 and a contoured open top 20. The top 20 is preferably cut in a contoured arc to form a relatively even, perimeter edge 22 with projecting ears 23 to assist in gripping when the flat bag-like liner is installed over the cylindrical plug bucket 14 as shown in FIG. 1 and then stretched over the paint bucket 12 as shown in FIG. 2.

Figure 2:
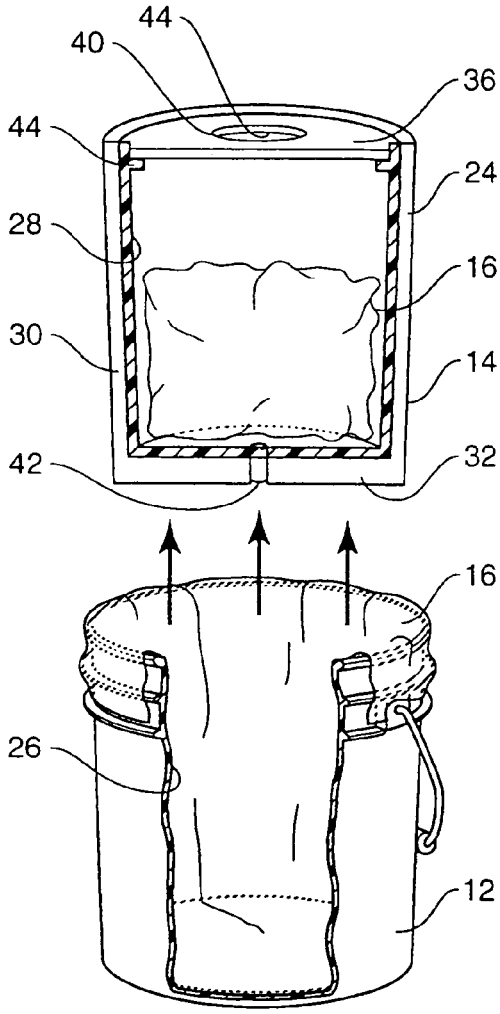
FIG. 2 is a perspective view, partially in section, of the paint bucket and liner of FIG. 1 with the liner installed.
Figure 3:
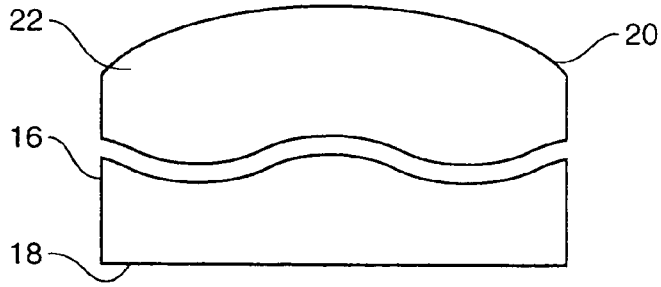
FIG. 3 is a side elevational view of an alternate embodiment of a disposable liner for a paint container.

Referring to the cross-section of the plug bucket 14 in FIG. 2, the plug bucket 14 has an outside surface 24 that is conformable to the inside surface 26 of the paint bucket 12. Preferably, the plug bucket 14 has a paper or plastic interior reinforcing shell 28 with an outer foam layer 30 around the shell 28 and a thick foam bottom 32.

The deformable foam layer 30 and foam bottom 32 on the outside of the shell 28 eliminates the effect of folds and wrinkles in the liner when the liner is installed in the paint bucket and air is forced out from between the liner 16 and the inside surface 26 of the paint bucket 12. The following preferred steps during installation insure that the impervious plastic liner 16 adheres by suction to the inside surface 26 of the paint bucket.

First, to install the liner 16 on the outside surface 24 of the plug bucket 14, the empty paint bucket 12 is set upside down on a flat surface. The plug bucket 14 is set upside down on the bottom 34 of the inverted paint bucket 12 which provides a convenient support. The plug bucket 14 has a recessed cover 36 which seats on the bottom 34 of the paint bucket 12. A liner 16 is inverted and pulled down over the outside of the plug bucket 14 until the sealed bottom 18 of the liner 16 is snug on the bottom 32 of the plug bucket 14.

Second, the empty paint bucket 12 is turned right-side up and the plug bucket 14 with the outside liner 16 is lowered into the inside of the paint bucket 12, as shown in FIG. 1. The plug bucket 14 is pressed into the interior of the paint bucket driving out all of the air between the liner and the buckets.

Third, the perimeter edge 22 of the liner is stretched and pulled down over a top outer rim 38 of the paint bucket 12 using the convenient ears 23 on the top of the liner. The liner is sized such that the perimeter of the open end of the liner 16 is slightly larger than the perimeter of the inside top of the plug bucket 14, but smaller than the top outer rim 38 at the open top end 39 of the paint bucket.

In this manner, a tight seal around the outer perimeter rim 38 of the paint bucket 12 is formed, preventing air from entering between the liner 16 and paint bucket 12 when the plug bucket 14 is withdrawn.

Finally, the plug bucket 14 is withdrawn using the convenient access hole 40 as a hand grip during removal. To relieve the plug bucket 14 from the installed liner 16, an air relief hole 42 is provided through the foam bottom 32 and shell 28 of the plug bucket 14. By eliminating air from between the liner 16 and the inside surface of the paint bucket 12, the liner is secured to the inside surface.

As shown in the cross-section of the plug bucket 14 in FIG. 2, the cover 36 seats on an inside lip 44 with the access hole 40 formed from a broken away segment (not shown) of the cover 36.

In kit form, the plug bucket 14 contains a supply of liners 16 which are individually withdrawn through the access hole 40 when one is being used. The plug bucket 14 is nested within the paint bucket and marketed as a package with use instructions. The complimentary buckets may be sized in one, two or five gallon sizes with liners to match. Furthermore, although a conventional plastic bucket with bail 46 and reinforcement band 48 is shown, any conventional or custom bucket may be used as the base element in the kit with other components sized and configured to match.

After use of a lined paint bucket, it is recommended that the remaining paint be returned to the original paint container and the residue paint be allowed to dry in the lined bucket before removal and disposal of the liner. In this manner, further exposure of the disposed liner to water will not result in run-off of undried paint. Alternately, the liner can be removed from the paint bucket 12 and maintained in an open condition until the residue paint dries before proper disposal. Notably, with the liner stretched over the top of the paint bucket, the top rim of the paint bucket is protected both during normal use with a brush, and during the process of returning excess paint to a paint can. When the liner is removed, the paint bucket is clean and ready for the next paint job.

Figure 4A:
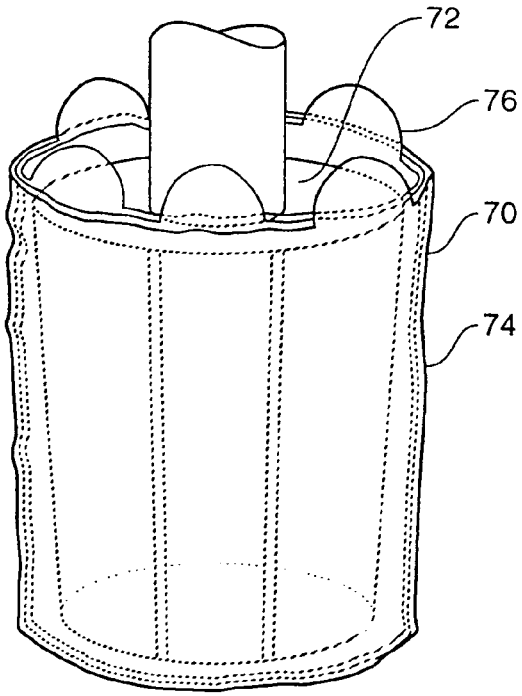
FIG. 4A is a side elevational view of a plurality of liners installed over an expandable mandrel.
Figure 4B:
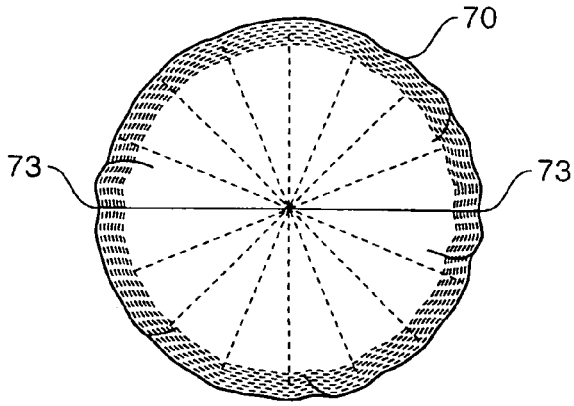
FIG. 4B is a bottom view of the plurality of liners on the mandrel of FIG. 4A.
Figure 5:
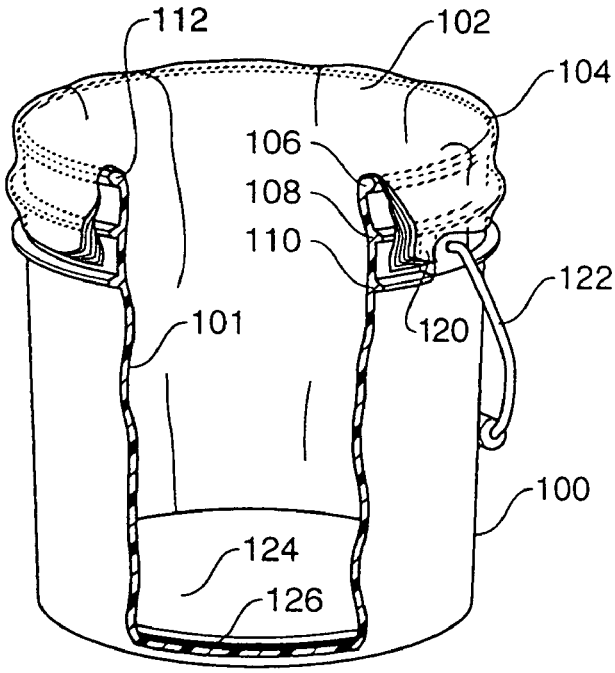
FIG. 5 is a perspective view, partially in section, of alternate embodiment of the paint bucket liner system including a conventional reusable paint bucket and a set of disposable liners.

Referring now to FIGS. 4 and 5, another alternate embodiment of the liner system is shown. The liner system includes a paint container in the form of a conventional, plastic paint bucket 100 with an inside surface 101 and a series of nested, paint-impervious liners 102 installed in the bucket. The bucket 100 has an open top 104 with a projecting lip 106 with one or more ribs 108, 110 around the outer upper rim 112 as shown in the cut-away of FIG. 5. The nested liners 102 are stretched over the projecting lip 106 and the upper rib 108 at the place of manufacture. The number of liners in a group is maximized since installation over the upper rim 112 can be accomplished mechanically. Liners with a 0.7 mil to 0.8 thickness have been found to function well when installed as a group of twenty four.

Figure 6:
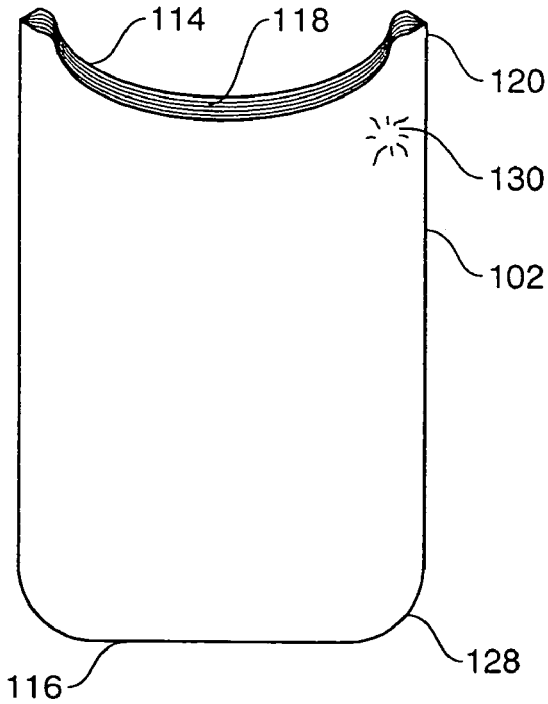
FIG. 6 is a side elevational view of a set of replacement liners for the paint bucket liner system of FIG. 5.

One configuration of the liners 102 is shown in FIG. 6. The liners 102 in FIG. 6 have an open top end 114 and a closed bottom end 116. The open top end 114 of the liners 102, when lying flat as shown in FIG. 6, have a curved, concave central portion 118 and a pair of raised end ears 120. The curved central portion 118 helps situate the open top end 114 substantially evenly around the outer upper rim 112, when the liners 102 are installed in the bucket 100 as shown in FIG. 5. The opposed end ears 120, shown in part proximate the handle bail 122, facilitate installation and removal, particularly when manually installing replacement liners as previously described. Factory installed liners may include only a single ear or tab to facilitate removal of each liner after use.

When installing liners at the factory, inexpensive rectangular liners can be utilized by radially staggering the liner 70 on an installation mandrel 72 as shown in FIGS. 4A and B. A mandrel that is expandable in diameter is preferred since the mandrel can be expanded after sequentially installing liners in a radially staggered position on the mandrel 72. With each liner rotated fifteen to twenty degrees from the previous liner the corners 73 are displaced from one another and do not interlock. Removal of the innermost liner after use of the paintbucket will thereby not dislodge the remaining liners. The mandrel 72 includes radially displaceable slats 74, which are expanded after the mandrel and installed liners are inserted into the bucket. Beginning with the outermost liner, the liners are sequentially pulled down over the bucket rim 112, such that the open top end 114 stretches over the projecting lip 106 and at least the uppermost rib 108 to create a seal that excludes reentry of air. After attachment of the liners to the bucket the mandrel is collapsed and withdrawn leaving the liners positioned against the inside wall and bottom of the bucket.

The staggering of liners 70 assists in separating the ears or tabs 76 for easy accessibility.

The liners are fabricated from a polymer sheet material that is stretchable with elasticity sufficient to firmly grip the top rim of the paint bucket when installed. Preferably the liners are fabricated with a side seal instead of from tubular stock to obtain the tolerances needed to allow the liner to conform to the inside of the bucket, yet be elastically retained on the outside perimeter rim. This in turn retains the liner on the inside surface of the paint bucket.

After a set of liners is installed at the time of manufacture and assembly, the installed liners are retained in position within the bucket by a cardboard plug 124 which is press-fit down at the bottom 126 of the bucket 100. The press-fit plug 124 holds the liners in place preventing gradual "puffing" of the liners 102 by air seepage during the period prior to sale. The cardboard plug 124 is removed before use and the liners are used one-by-one until the liners are used up.

The set of nested liners 102 as shown in FIG. 6 have rounded corners 128 at the closed bottom end 116. The rounded corners 128 prevent the corners of nested liners from becoming interlocked resulting in the remaining liners being dislodged when a soiled liner is removed. The end ears 120 facilitate removal of a single liner from the bucket by providing a convenient tab for selectively grasping the top of the inner most liner.

Nested liners provide a convenient means of supplying and storing a relatively large number of liners in the original bucket. However, because of the greater thickness of the preferred liner, the liners are more difficult to stretch over the rim of the bucket. Therefore, replacement liners are either provided singly in a resupply bucket as previously described with reference to FIG. 2, or in a set of four or five nested liners that can be installed as a group on an empty bucket. In such instance, multiple sets can be stored in a plug bucket 14 and kept from separating during storage by a small thermal weld 130 as shown in FIG. 6, which holds the set of replacement liners together until use. The weld 130 is not included in the original liner set installed by the manufacturer.

Figure 7:
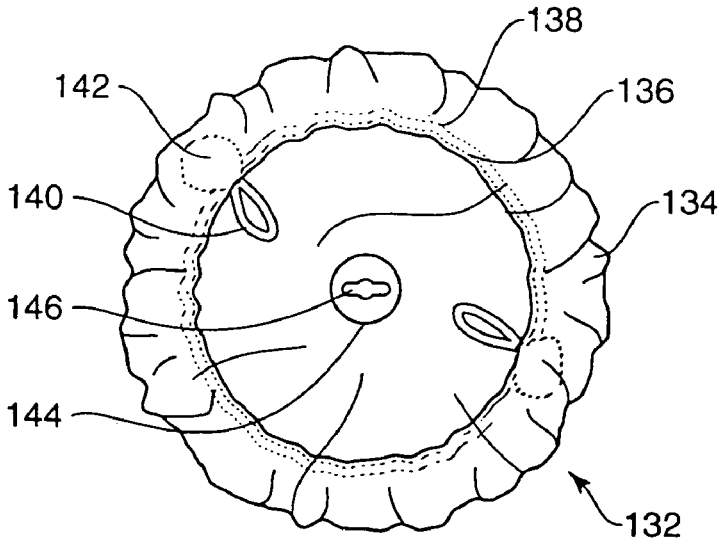
FIG. 7 is a bottom view of a flexible bucket cap usable with the paint bucket liner systems of FIGS. 1 and 5.
Figure 8:
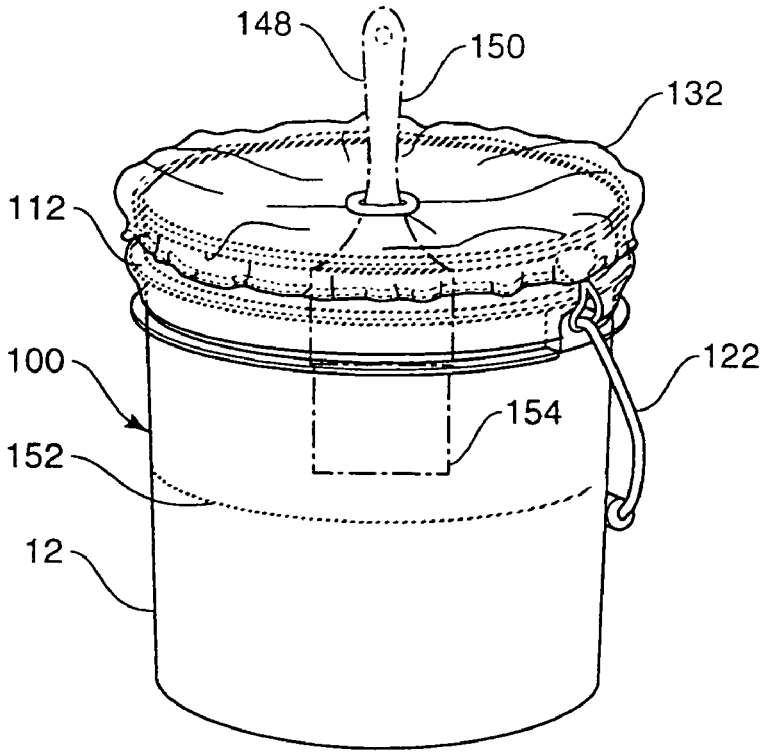
FIG. 8 is a perspective view of the flexible bucket cap of FIG. 7 installed on a paint bucket of the type in FIG. 5.

Referring to FIGS. 7 and 8, the liner system preferably includes a bucket cover comprising a bucket cap 132. The bucket cap 132 is formed of a flexible, transparent plastic sheet material 134 that permits viewing of the inside of the paint bucket 12 when installed. The sheet material 134 has a perimeter 136 that is bunched and attached to a circumferential elastic band 138 in a manner similar to a conventional shower cap. The elastic band 138 has two extension loops 140 attached to the band 138 with reinforcing patches 142. The loops 140 are attached to the bucket bail 122 with wire ties (not visible). In this manner the bucket cap 132 is preferably installed on the paint bucket at the time of manufacture with the bucket cap 132 rolled-up and stored along the side of the upper rim 112 until needed.

The bucket cap 132 has a central reinforcement patch 144 with a keyhole slot 146. The bucket cap 132 is useful for covering a lined paint bucket containing paint, for example, when left overnight. The bucket cap 132 prevents a film from forming on the paint during periods of non-use. The key-hole slot allows a paint brush 148 to be supported in the covered bucket 12, as shown in phantom in FIG. 8. Prior to stretching the bucket cap 132 over the top of the bucket 12, the handle 150 of the paint brush 148 is poked up through the keyhole slot 146, which grips the handle by friction allowing the paint brush 148 to be adjusted and suspended over or into a level of paint 152 indicated by dotted line in FIG. 8. In this manner the brush can drip excess paint without the paint hardening on the bristles 154. Alternately, in larger sized buckets the slot may receive a spray gun nozzle or a roller handle. It is to be understood that the bucket cap can be utilized without the liner system, but is preferably and advantageously utilized with the liner system in a kit. The oversized cap easily accommodates the set of pre-installed liners. The bucket cap 132 contributes to the goal of minimizing the clean-up and disposal of paint residue after each painting session, and thereby contributes to the ecological benefits of the system and kit.

While, in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A paint bucket and liner system comprising:

a paint bucket having an inside surface including a bottom, and an open top end with a perimeter rim;

an impervious liner with an open top installable within the paint bucket and securable to the inside surface of the paint bucket by pressing out air between the liner and inside surface of the paint bucket; and, pressing means having an outside surface and bottom that are sized and shaped to the diameter of the inside surface and bottom of the paint bucket for pressing the liner against the inside surface and bottom of the paint bucket and pressing out air from between the liner and the inside surface of the paint bucket when the pressing means is inserted in the paint bucket with the liner located between the pressing means and paint bucket.

2. The paint bucket and liner system of claim 1 wherein the liner has a resiliency and the open top has a stretchable perimeter edge wherein the stretchable perimeter edge of the liner is stretched and pulled down over the perimeter rim of the paint bucket to prevent air re-entry when the liner is installed within the paint bucket.

3. The paint bucket and liner system of claim 1 wherein the pressing means comprises a plug device.

4. The paint bucket and liner system of claim 3 wherein the liner is installable over the outside surface and bottom of the plug device and the plug device is insertable within the paint bucket during installation.

5. The paint bucket and liner system of claim 4 wherein the plug device comprises a plug bucket having a top and a cover with an access opening wherein a plurality of liners are contained in the plug bucket.

6. The paint bucket and liner system of claim 1 wherein the perimeter rim of the paint bucket outwardly projects from the open top of the paint bucket and the liner is fabricated from a stretchable plastic and sized to stretch over the rim during installation.

7. The paint bucket and liner system of claim 1 wherein a plurality of nested liners are installed in the paint bucket and each of the nested liners has an open top with a perimeter edge with at least one projecting ear at the perimeter edge at the open top for enabling convenient removal of each liner after use.

8. The paint bucket and liner system of claim 1 wherein the liner is fabricated from a thin polymer sheet.

9. The paint bucket and liner system of claim 7 wherein the system has a removable retainer installed within the nested liners at the bottom of the liners the retainer being sized to hold the liners at the bottom of the paint bucket and retain the liners against the inside surface of the paint bucket before use.

10. The paint bucket and liner system of claim 1 wherein the bottom of the paint bucket has a bottom perimeter and wherein the liner is stretchable and is dimensioned to conform to the inside surface and perimeter of the bottom of the paint bucket when the open top of the liner is stretched over the perimeter rim of the paint bucket.

* * * * *